United States Patent [19]

Philipenko

[11] 4,316,393

[45] Feb. 23, 1982

[54] SOIL SAMPLER AND MOUNTING ARRANGEMENT

[76] Inventor: Harry Philipenko, Box 294, Max, N. Dak. 58759

[21] Appl. No.: 156,331

[22] Filed: Jun. 4, 1980

[51] Int. Cl.[3] ..... G01N 1/08

[52] U.S. Cl. ..... 73/864.45

[58] Field of Search ..... 73/864.31, 864.44, 864.45; 280/727, 760, 762, 769; 296/43

[56] References Cited

U.S. PATENT DOCUMENTS

| | | | |
|---|---|---|---|
| 2,643,858 | 6/1953 | Hardman | 73/864.45 |
| 2,709,368 | 5/1955 | Wolpert | 73/864.45 |

*Primary Examiner*—S. Clement Swisher

*Attorney, Agent, or Firm*—Brisebois & Kruger

[57] ABSTRACT

A soil sampler assembly includes an adjustable frame to facilitate its mounting on a motor vehicle. A motor of the sampler assembly is mounted so its vertical position can be adjusted to permit obtaining soil samples of significant depth by adjusting the motor to a lower-most position relative to the vehicle. The motor is of the hydraulic type and is powered with a portable electric motor driven hydraulic pump and a four-way valve control. The soil sampler assembly can be quickly and easily mounted on or dismounted from a motor vehicle such as a pick-up truck.

8 Claims, 5 Drawing Figures

SOIL SAMPLER AND MOUNTING ARRANGEMENT

FIELD OF THE INVENTION

The invention relates to a soil sampler which can be of the hydraulic type, and a mounting arrangement for quickly and rigidly mounting the sampler on the rear of a vehicle such as a pick-up truck, with the axis of the sampler vertical.

BACKGROUND OF THE INVENTION

Soil samplers of various types are known in the prior art. Such samplers can be of the auger type which rotate as the sampler is pushed into the earth, or can be of the force type in which a hollow cylinder is driven vertically into the earth. In each instance, the object is to obtain a representative sample of the earth from the surface to a shallow depth.

Such samples are of value, for example, to farmers, to take soil samples for subsequent analysis to determine the chemical constituents of the soil. On the basis of the soil analysis, the farmer can accurately fertilize and otherwise treat the soil to provide the required acidity or sweetness (alkalinity) for the crop to be planted.

Such soil tests are also of value in home construction to ascertain the nature of subsoil so that required footings and foundations as well as any required reinforcing can be ascertained and provided.

In the past, power actuated earth samplers have been heavy and cumbersome and have required special mounting arrangements to mount them on, for example, tractors or pick-up trucks. As a result of the difficulty in mounting the soil samplers on a vehicle, the vehicle is frequently used as a special purpose vehicle primarily for taking soil samples. As a result, the person requiring the soil sample to be taken was compelled to call on someone with such a permanently mounted soil sampler, the expense of a vehicle permanently equipped with a soil sampler being prohibitive, and the inconvenience of removing and replacing the soil sampler making it uneconomical for the farmer or builder to have his own. Several hours of mounting time were frequently required to operationally mount the soil sampler on the vehicle in the case of the known prior constructions. As a result, the farmer or builder was required to hire a soil sample taker at considerable expense.

In accordance with applicant's invention, these shortcomings of the prior art are effectively overcome in an inexpensive and reliable manner.

SUMMARY OF THE INVENTION

In accordance with this invention, a soil sampler assembly is provided which can readily be used by persons requiring soil samples, such as farmers or builders which require a sample of soil or earth in a particular location.

In accordance with the invention, in a preferred embodiment, the soil sampler assembly includes a motor which drives a sample taker or probe into the soil so that an elongated cylindrical soil sample is cut by and remains in the body of the probe. The probe is then withdrawn and the sample extracted for any desired or required testing.

In a preferred embodiment, the motor takes the form of an hydraulic cylinder connected to a source of hydraulic fluid under pressure, the arrangement including a reversing valve for selectively extending or retracting the piston rod of the cylinder.

A significant feature of the soil sampler assembly of the invention resides in a relatively simple, yet reliable and rugged mounting arrangement for mounting the soil sampler on a motor vehicle so it can quickly be mounted on or removed from the vehicle thereby freeing the vehicle for use for other purposes because of the very short time required for mounting and removal.

In accordance with the invention, there are only three mounting connections between a motor vehicle such as a pick-up truck and the soil sampler assembly. These connections include a connection to a bumper plate (or a horizontal plate mounted at the rear of the vehicle if the vehicle does not have a horizontal bumper plate), and connections to a stake hole on each side of the vehicle via stakes which brace the upper end of a support frame of the soil sampler assembly via adjustable brace arms the lengths of which are adjustable to permit accommodating the soil sampler assembly to different makes of vehicles in which the stake holes are different distances from the rear of the vehicle.

A further feature of the invention is a mounting arrangement for the soil sample taker which permits at least initial adjustment of the sample taker and its drive motor vertically to adapt the sample taker to the vertical height of the horizontal plate to which the sample taker is attached at the rear of the vehicle.

Correspondingly, an object of the invention is to provide a soil sampler assembly which is relatively simple in construction, is inexpensive to fabricate, can be adapted by virtue of its mounting arrangement to be easily mounted on different types and sizes of motor vehicles, can be quickly and easily mounted on a motor vehicle, and is relatively inexpensive compared to known prior art soil sampler assemblies.

Numerous features and advantages of this invention will become apparent from consideration of the accompanying drawings and the detailed description which follows, and in which a non-limiting preferred embodiment is shown and described in detail.

DETAILED DESCRIPTION

Figure 1:
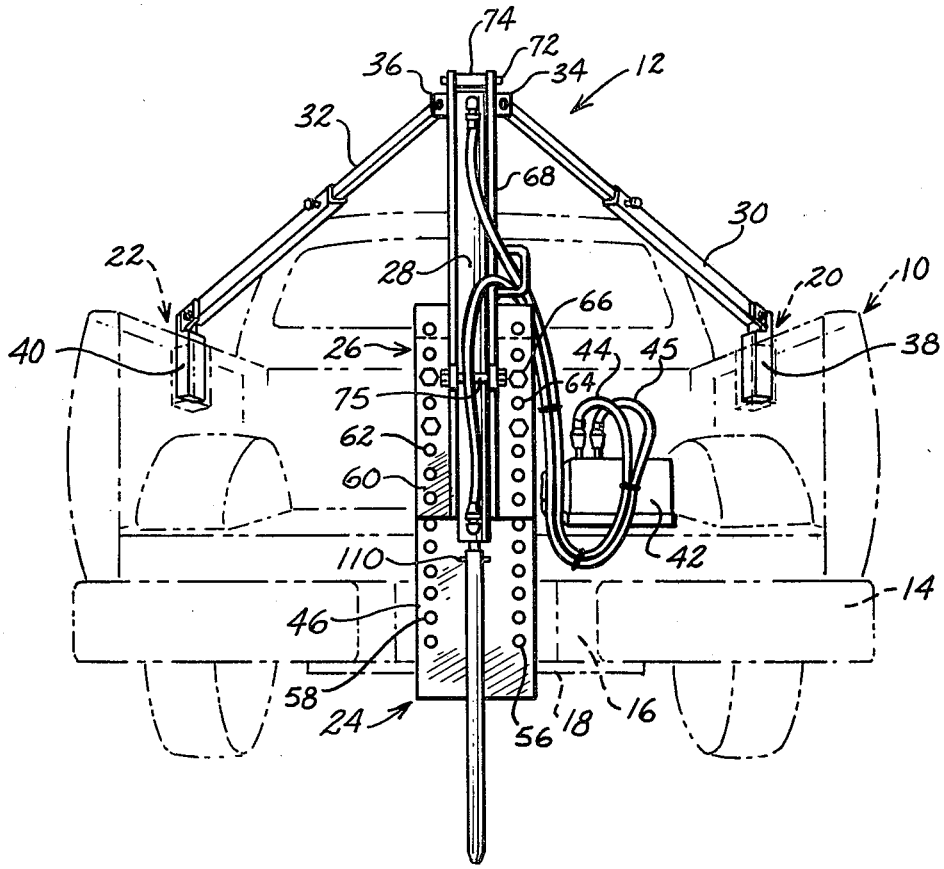
FIG. 1 is a perspective view showing the soil sampler assembly of the invention mounted on the rear of a vehicle which is shown in phantom lines.
Figure 2:
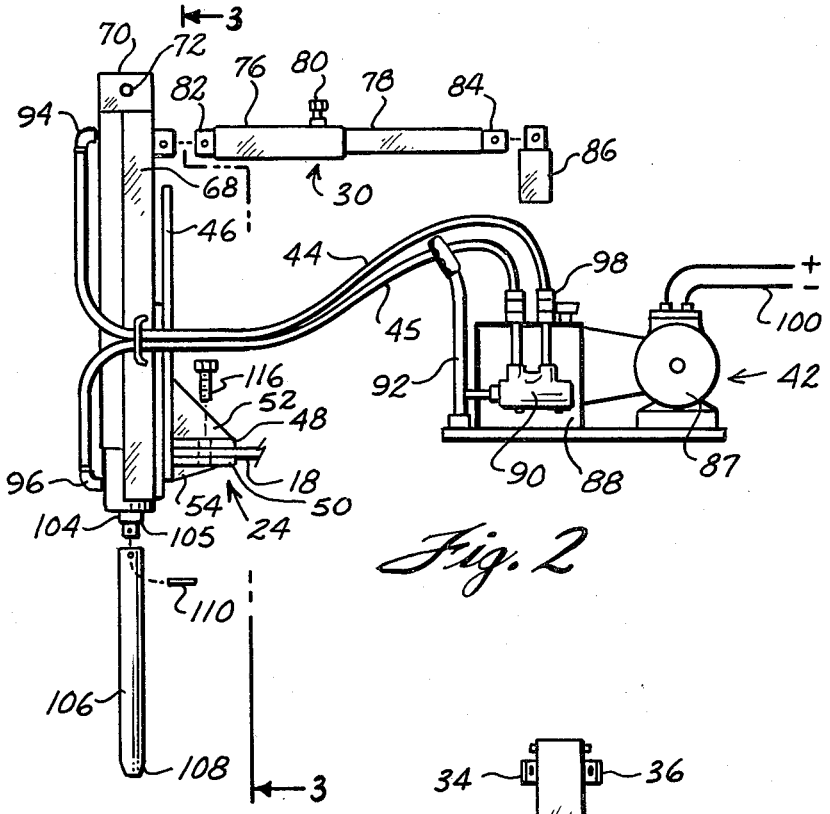
FIG. 2 is an exploded partly schematic side view in elevation of the sampler assembly of FIG. 1.
Figure 3:
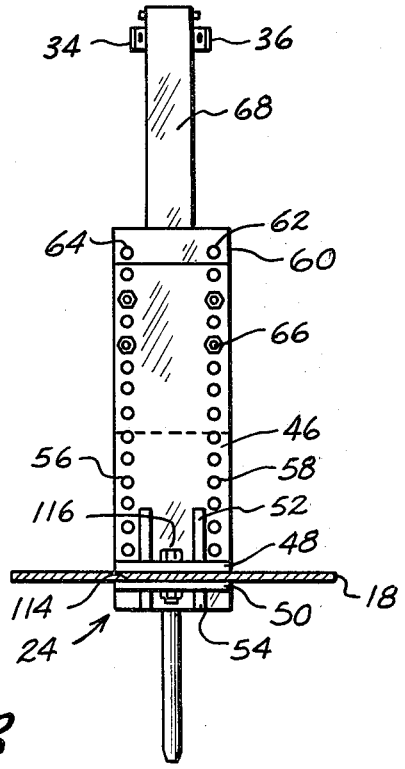
FIG. 3 is a view in section taken along line 3—3 of FIG. 2.
Figure 4:
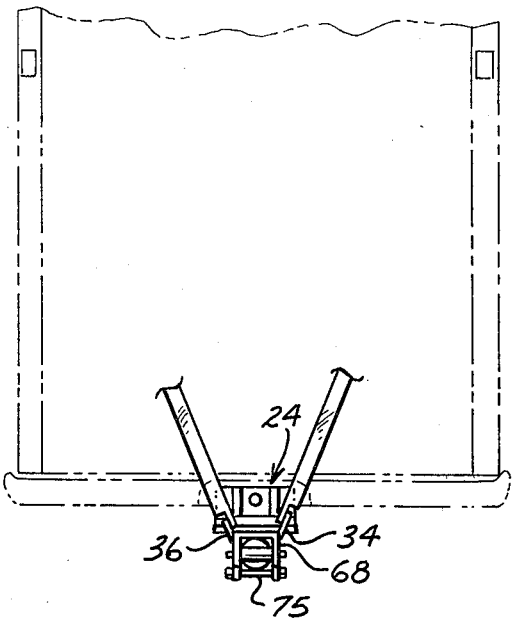
FIG. 4 is a partial top plan view of the soil sampler assembly.

With reference to the drawings, particularly FIG. 1, there is shown in phantom lines a motor vehicle in the form of a pick-up truck 10 on which the soil sampler assembly 12 of this invention is mounted. Vehicle 10 can typically have a bumper 14, the center of which can be recessed, as at 16, and which is provided with a flat horizontal plate 18 which can be used as a step to climb into the rear of the vehicle. The vehicle 10, when it is a pick-up truck, will typically have several stake openings such as 20 and 22 provided in each side wall of the truck and which are typically used to receive side rails to increase the height of the sides of the truck.

The soil sampler assembly 12 is secured to vehicle 10 at only three connection points. These connection points are at the stake holes 20 and 22, and at the plate 18, and will subsequently be described in detail.

Soil sampler assembly 12 includes a mounting frame 24 secured to plate 18, a support frame 26 secured to the mounting frame, a hydraulic cylinder 28 secured to the support frame and which comprises the motor means of the assembly, two brace arms 30 and 32 secured to ears 34 and 36 respectively at the upper end of the support frame 26, and stakes 38 and 40 connected respectively to the ends of the arms 30 and 32. Where the motor means takes the form of an hydraulic cylinder 28, an electrically powered hydraulic pump unit 42 is provided which is connected to the hydraulic cylinder by hoses 44 and 45.

As shown at FIGS. 1–4, mounting frame 24 includes an upright rectangular plate 46 with a pair of parallel spaced apart plate like flanges 48 and 50 extending horizontally from the plate 46 near its lower end. Flange 48 is secured to plate 46 by welding, and triangular braces 52 are included in the welded connection for additional strength. Similarly, triangular brace flanges 54 from part of the welded connection of flange 50 to mounting plate 46. Triangular braces 52 and 54 are equi-distantly spaced on opposite sides of the center line of mounting plate 46 but are inwardly of rows of bolt holes 56 and 58, the rows of holes being parallel with the side edges of mounting plate 46. The respective holes 56 are equidistantly spaced vertically and the holes 58 are also equi-distantly spaced vertically, a hole 56 preferably being horizontally aligned with a hole 58.

Support frame 26 includes an upright horizontal plate 60 of a height less than the height of plate 46. Plate 60 has a plurality of bolt holes 62 and 64 vertically spaced and horizontally aligned so that these bolt holes mate with the bolt holes 56 and 58 of plate 46. Plate 60 can thus be bolted to plate 46 using several bolt and nut assemblies 66. Support frame 26 also includes a channel 68 of U-section which is welded to that surface of the plate which faces away from the rear of the pick-up truck. Channel 68 extends a substantial distance above the upper edge of plate 60 and has lugs 70 at its upper end. These lugs have openings to receive a pin or bolt 72 which passes through an eye 74 in the upper end of cylinder 28 to connect the upper end of the hydraulic cylinder 28 to the support frame. A clamp bolt 75 extends through enlarged ears of the channel to clamp the body of the hydraulic cylinder so it cannot pivot about the pin 72.

Brace arms 30 and 32 are each of adjustable length and include two sections 76 and 78, section 78 telescoping within section 76. Section 76 takes the form of a square tube which telescopically receives therein the smaller size square tube 78. A lock bolt 80 maintains the sections 76 and 78 in their telescopically adjusted position. Ears 82 and 84 are provided respectively at the free ends of the sections 76 and 78. Ear 82 is connected to ear 34 at the upper end of support frame 26 by a suitable bolt and nut. Ear 84 is connected to a rectangular stake 86, also with a bolt and nut fastener. Until the bolt and nut assemblies are tightened, the brace arms, such as brace arm 30, are free to pivot at their respective ends relative to support frame 26 and stake 86.

Hydraulic pump unit 42 preferably takes the form of a hydraulic power pack having a 12 or 24 volt motor 87 which drives a hydraulic pump 88. This hydraulic power unit typically includes a four-way reversing valve manually controllable by a control lever 92. Hoses 44 and 45 are connected respectively to the cylinder end 94 and the rod end 96 of hydraulic cylinder 28. The other ends of these hoses are connected to different passages of the four-way valve 90.

The preferred coupling between the hoses and the four-way valve comprises quick coupler connections such as 98 which permit quickly disconnecting the hoses from the hydraulic power unit 42 so that the power unit can be used for other purposes. The quick coupler arrangement also simplifies mounting the soil sampler assembly on the vehicle since the hydraulic power unit can be separately lifted and placed in the rear of the truck. The electric motor 87 is of course connected to the battery or alternator of the motor vehicle by suitable cables 100.

Four-way valve 90 is preferably of the type having a neutral or intermediate position in which all flow of hydraulic fluid through the hoses is stopped. It will of course be appreciated that this four-way valve 90 is of the type which in one position feeds pressurized hydraulic fluid to the head end 94 of the cylinder while simultaneously venting the rod end 96 to a reservoir in the hydraulic power unit, and in the other position supplies pressurized hydraulic fluid to the rod end 96 of the cylinder while venting the cylinder or head end 94.

Connected to the piston rod 104 of hydraulic cylinder 28 is a soil sample taker or probe 106 in the form of a hollow pipe with its lower end 108 sharpened. Sample probe 106 is a close sliding fit on a reduced diameter lower end of the piston rod and abuts a shoulder 105 of the rod. The probe is removably secured to piston rod 104 with a bolt or pin 110 which is extended through opening in the upper end of the probe and the rod, which align when the probe is seated on the rod.

The mounting arrangement of soil sampler assembly 12 on the motor vehicle 10 is a significant feature of this invention. This quick mounting arrangement permits mounting the assembly 12 on the vehicle in a matter of minutes because of the simplicity of the mounting arrangement and the fact that there are only three connections between the assembly and the body of the vehicle. To mount the assembly on the vehicle for the first time, support frame 26 with the hydraulic cylinder mounted thereon is bolted to mounting frame 24. Then, the so assembled unit is lifted to a position in which the slot 114 between flanges 48 and 50 is aligned horizontally with plate 18 and the assembly is simply moved inwardly toward the rear of the vehicle until openings in flanges 48 and 50 are aligned with an opening in plate 18. A fastening bolt 116 is then inserted through these aligned openings and tightened to secure this assembly to plate 18.

Next, the stakes at the ends of the respective arms 30 and 32 are inserted in the stake holes 20 and 22, the arm lock bolts 80 are loosened, and the arms are adjusted to permit making the bolt and nut connection between the ears 34 and 36 and the corresponding ends of the arms 30 and 32 respectively. After these connections are made, the bolts at each end of each arm are tightened and the lock bolts are also tightened, and the soil sampler assembly is thus mounted on the motor vehicle 10. The hydraulic power unit 42 which is carried in the back of the truck, can then be connected to the cylinder with the quick couplers 98, and the unit is ready for operation.

In the event that it is necessary to use the motor vehicle for purposes other than soil sample taking, removal of the assembly is quickly and easily accomplished by simply loosening the bolts at each end of each arm, which permits withdrawing the stakes at the ends of the arm from the stake holes, removing the securing bolt 116, and sliding the unit rearwardly off plate 18.

By virtue of the holes 56 and 58 in mounting frame 24 and the corresponding holes 62 and 64 in mounting plate 60, the hydraulic cylinder 28 can be mounted at numerous vertical positions with respect to the plate 18, and correspondingly, this permits adjustment to accommodate the soil sampler assembly on different vehicles having a plate 18 at different vertical heights. Similarly, the telescopically adjustable brace arms 30 and 32 which brace the upper end of the hydraulic cylinder permit inserting the stakes at the ends of the arms in stake holes of the vehicle regardless of different spacing of the stake holes relative to the rear of the vehicle.

It will of course be appreciated that after an initial or first installation of the soil sampler assembly, the telescopic arms are adjusted to the proper length and need not be readjusted. Further, after support frame 26 is connected to mounting frame 24 at the proper position, no further change in this position is required.

Different makes of motor vehicles frequently have stake holes of different sizes. By virtue of the bolted connection between each arm and its stake, it is contemplated that stakes of different sizes can thus be provided to be a close fit in the stake holes of the vehicle body. Alternatively, adjustable stakes can be used.

Figure 5:
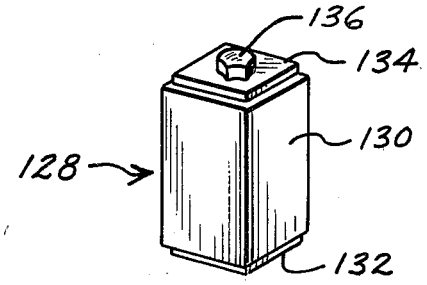
FIG. 5 is a pictorial view of an adjustable stake for the soil sampler assembly.

Such an adjustable stake 128 is shown at FIG. 5. This stake takes the form of a resilient square or rectangular body 130 with a plate 132 at its lower end into which a bolt 136 which extends through body 130 is threaded. This form of stake also has an upper plate 134 to cause the body 130 to be compressed axially and thereby expand laterally as bolt 136 is tightened.

When the adjustable stake is used, the square tube section 78 of a brace arm is removed from the section 76 and is rotated 90° so that its ear 84 is horizontal rather than vertical. This permits inserting bolt 136 through the opening in ear 84 vertically, and after stake 128 is inserted in the stake hole, bolt 136 is tightened to both fix the stake in the hole and fix the corresponding end of a brace arm to the stake.

It will of course be understood that if the motor vehicle 10 on which the soil sampler assembly is mounted is not provided ith a horizontal plate 18, that such a plate can be fitted to the vehicle and secured by welding or bolting. The plate must of course have sufficient depth from front to back to permit substantial engagement with the facing surfaces of the flanges 48 and 50. A hole is of course provided in the plate to receive the fastening bolt 116.

In use, the vehicle 10 on which the soil sampler assembly 12 is mounted is driven to the desired location such as a farmer's field where the soil sample is to be taken. Sample probe 106 is then slipped onto the lower end of piston rod 104 until it abuts shoulder 105. Retaining bolt 110 is then inserted to fix the probe to the piston rod. Next, motor 87 is started and control lever 92 is manipulated to first drive the sample taker 106 into the soil, and to then withdraw the sample taker from the soil. The desired sample is cut by the sample taker or probe 106 and is retained therein when the probe is retracted. The probe 106 is then removed from the piston rod and the sample is ejected into an appropriate container for further analysis or study.

When the required samples have been taken, it is a relatively simple matter to remove the soil sampler assembly 12 from the vehicle so that the vehicle can be used for other purposes.

While a preferred embodiment has been shown and described, it is to be understood that numerous changes can be made without departing from the scope of the invention as specified herein and defined in the claims.

What is claimed is:

1. A soil sampler assembly comprising
a support frame,
motor means for driving a soil sample taker,
means securing said motor means to said support frame,
a mounting frame,
means securing said support frame to said mounting frame,
first and second generally horizontal brace arms,
means connecting common ends of said arms to said mounting frame, adjacent on upper portion thereof, for pivotal adjustment of the arms relative to the mounting frame,
stake means at ends of said arms remote from the mounting frame,
means connecting each stake means to an arm for pivotal adjustment of the stake means relative to the arm,
said stake means comprising means insertable into stake holes of a motor vehicle for removably connecting the stake means to the body,
means on said mounting frame for removably securing said frame to an end of the vehicle with said soil sample taker beyond the vehicle end, and
means connecting said motor means to a power source on the vehicle, where, said sampler assembly can be quickly and easily mounted on the vehicle by connecting the stake means and support frame, and can be quickly and easily removed by disconnecting the stake means and support means from the vehicle.

2. A soil sampler assembly according to claim 1, wherein said brace arms include means for adjusting the length of each of said arms.

3. A soil sampler assembly according to claim 1, wherein said means securing said support frame to said mounting frame comprises means for securing the support frame to the mounting frame at different elevations relative to the mounting frame.

4. A soil sampler assembly according to claim 1, wherein said motor means comprises a hydraulic cylinder mounted on said support frame with the axis of the cylinder generally vertical.

5. A soil sampler assembly according to claim 4, wherein said means securing said motor means to the support frame comprises means releasably securing said cylinder to said support frame.

6. A soil sampler assembly according to claim 4, wherein said soil sampler taker comprises an elongated tube releasably connected to a drive member of said hydraulic cylinder.

7. A soil sampler assembly according to claim 1, wherein said means on said mounting frame for removably securing the mounting frame to an end of the vehicle comprises a horizontal flange engageable with a horizontal plate on the vehicle at the rear thereof, and fastener means securing said flange to the plate.

8. A soil sampler assembly according to claim 7, further comprising a second horizontal flange parallel with and spaced from said first horizontal flange, said flanges defining a slot for receiving therebetween the plate at the rear of the vehicle.

* * * * *